US005862644A

United States Patent [19]

Jones

[11] Patent Number: 5,862,644

[45] Date of Patent: Jan. 26, 1999

[54] TILE SETTING HAND TOOL

[76] Inventor: Grant Jones, 34036 Amber Lantern, Apt. B, Dana Point, Calif. 92629

[21] Appl. No.: 985,231

[22] Filed: Dec. 4, 1997

[51] Int. Cl.[6] ..... E04G 21/16

[52] U.S. Cl. ..... 52/749.11

[58] Field of Search ..... 52/749.11; 294/3.5

[56] References Cited

U.S. PATENT DOCUMENTS 2,642,674 6/1953 Schell, Jr. ..... 52/749.11 X

FOREIGN PATENT DOCUMENTS 210162 9/1940 Switzerland ..... 52/749.11

*Primary Examiner*—Christopher Kent

[57] ABSTRACT

A tile setting hand tool for setting floor tile in a bed of mortar comprises a base plate having an under surface and an upper surface, and having a length, L, a width, W, and a thickness, t. A number, N, of pins or nails is attached to the plate, each being spaced apart from one another and each depending a distance, d, from the plate under surface; and including a handle projecting upwardly from the plate upper surface. The plate is preferably constructed from wood. The dimensions L, W, and t are preferably twelve inches, three inches and one-half, respectively. The pins or nails are arranged in three parallel and side-by-side columns, each having nine equally spaced part pins or nails. Preferably finishing nails are used which project about three-quarters of an inch from the under surface of the plate. Plurality of columns and rows. Lower regions of at least side edges of the plate are beveled inwardly about 45 degrees to match beveled side edges of typical floor tiles.

20 Claims, 3 Drawing Sheets

TILE SETTING HAND TOOL

BACKGROUND OF THE INVENTION

1. Field of the Invention

The present invention relates generally to the field of tile installation tools and devices, and more particularly to such hand tools or devices useful for setting ceramic or stone floor tiles.

2. Background Discussion

As anyone who has ever attempted to install ceramic or stone floor tiles can testify, the maintaining of a level and uniform set-tile surface is extremely difficult even for professional tile setters. Most of this difficulty is associated with laying down a uniform layer of tile mortar into which the tiles are set.

Currently, as far as is known to the present inventor, such tile-setting mortar is more or less leveled with a screen having a toothed edge or by a wooden or steel "float." Neither of these tools are, however, particularly effective for use with relatively heavy tiles which must ordinarily be set downwardly into the mortar. This problem is, at least in part, caused by the dense nature of the mortar laid onto the base surface of which the tiles tend to float. Some attempts have been made to "fluff" up or aerate the tile setting mortar with edges of the existing tile setting tools; however, it has been determined by the present inventor that such techniques are not very satisfactory in providing a smooth and even tile surface after installation of the floor tiles.

For these and other reasons, a principal objective of the current invention is to provide a special tile set hand tool which enables the easy and uniform fluffing or aerating of tile setting mortar so as to permit the tiles to sink uniformly into the tile setting mortar, and thereby provide for a uniform and level floor tile surface after installation of the floor tiles on a relatively flat, level sub-floor or substrate.

SUMMARY OF THE INVENTION

In accordance with the present invention, there is provided a tile setting hand tool for setting floor tile and the like in a bed of mortar. The tile setting tool comprises a base plate having an under surface and an upper surface, and having a length, L, a width, W, and a thickness, t. Included is a number, N, of pins or nails attached to the plate, each of the pins or nails being spaced apart from one another and each depending a uniform distance, d, from the plate under surface. Further included is a handle projecting upwardly from said plate upper surface.

In accordance with a preferred embodiment of the invention, the plate is constructed from wood and wherein the thickness, t, is equal to about one-half inch. Also preferably, the plate length, L, is about twelve inches and the plate width, W, is about three inches.

In the preferred embodiment, pins or nails are arranged in a plurality of columns and rows, with three parallel and side-by-side columns along the length of the plate being preferred. The number, N, of pins or nails is preferably twenty-seven with each of the three columns containing nine equally spaced apart pins or nails.

The projection distance, d, of each of the pins or nails is about three-quarters of an inch, with finishing nails being preferred that lower regions of at least side edges of said plate are beveled inwardly at an angle, $\alpha$, which is about 45 degrees.

The tile setting tool so provided is guided by previously set tiles and is useful for aerating the mortar bed on which the floor tiles are to be set, so that the tiles can be set a short depth into the mortar for good bonding and to enable easy leveling of the tiles when the aerated mortar bed "gives" to both accept the placing of the tile and the following subsequent leveling operation of tamping the tile into a level plane. Contrary to standard tile tool setting techniques, when this tile setting tool is employed, the proper elevation of tile does not depend upon the surface condition of the subfloor, thereby allowing dips and crowns to become nonissues.

BRIEF DESCRIPTION OF THE DRAWINGS

The present invention can be more readily understood by a consideration of the following detailed description when taken in conjunction with the accompanying drawings, in which.

In the various FIGS., the same elements and features are given the same reference numbers.

DESCRIPTION OF THE PREFERRED EMBODIMENT

Figure 1:
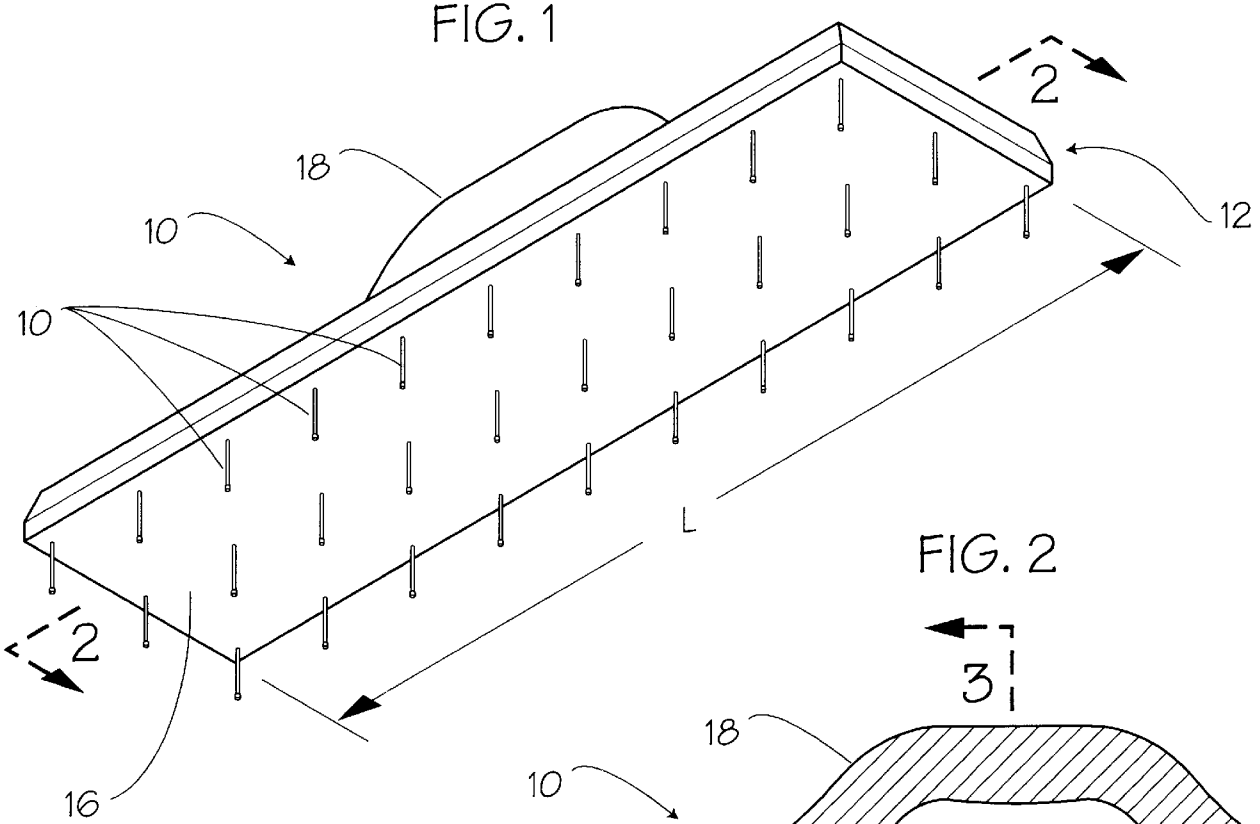
FIG. 1 is a perspective drawing of the tile set hand tool according to a preferred embodiment of the present invention, looking upwardly from the under side of the tool and showing three rows of three columns of nine nails each which protrude downwardly from a plate having a handle attached thereto.

In accordance with a preferred embodiment of the present invention there is shown in FIG. 1 a tile set hand tool or device 10 in accordance with a preferred embodiment of the present invention. Shown comprising hand tool or device 10 is a relatively thin, elongate plate 12 into which a number, N, of nails or pins 14 are installed so as to depend from a lower surface 16 thereof. A conventional handle 18 is attached to an upper surface 20 of plate 12, in a central location thereof (FIGS, 2 and 3).

Figure 2:
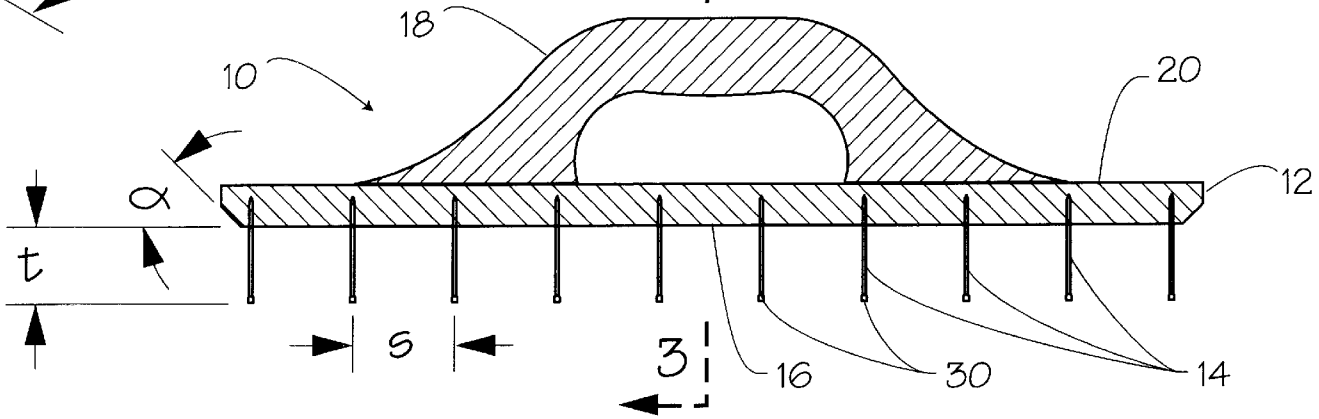
FIG. 2 is a longitudinal cross sectional drawing taken along line 2—2 of FIG. 1, showing a column of nine nails and showing features of the plate into which the nails are installed and showing beveled end regions of the plate into which the nails are driven or otherwise installed.
Figure 3:
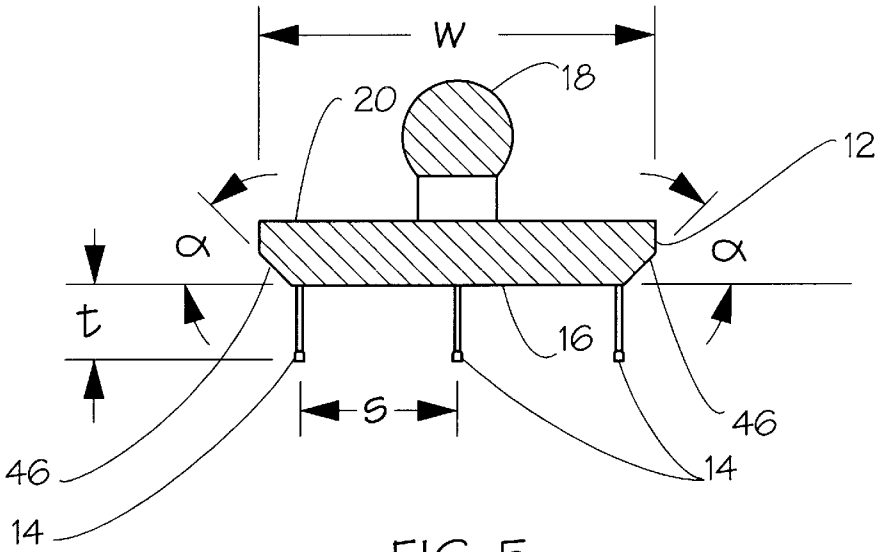
FIG. 3 is a transverse cross sectional drawing looking along line 3—3 of FIG. 2 and showing a row of three nails and showing beveled side edge regions of the plate into which the nails are driven or other wise installed.

More particularly described with respect to FIGS. 1–3, plate 12 is preferably constructed from a hard wood, such as mahogany or oak, or from a piece of exterior plywood, neither of which will warp when used for long periods of time with wet mortar and when washed off after each use. By way of example, with no limitation being thereby intended or implied, plate 12 may have a length, L, of about twelve (12) inches and a width, W, of about three (3) inches. Plate 12 preferably has a thickness, t, of about one-half (½) inch. Lower regions of end and side edges of plate 12 are beveled at an angle, $\alpha$, of about 45°.

The present inventor has discovered that three columns of nine pins or nails 14 each are useful for loosening up the tile mortar, as described below. Preferably nails are used because they can be hammered into plate 12 to whatever depth is desired. A material is used for plate 12 that does not split easily so that nails 14 can be driven into the plate without splitting the plate. For a plate 12 that is twelve inches long and three inches wide, a column-to-column and a row-to-row spacing, S, of 1½ inched is provided.

Nails 14 are preferably finishing nails that have an overall length of about 1½ inches and are driven into plate 12 so that the head end of the nails protrude a uniform distance, d, of about ¾ of an inch below plate under surface 16 (FIG. 2). The use of finishing nails is preferred because the slightly-enlarged nail heads 30 assist in the mortar-aerating operation described below.

OPERATION OF TOOL 10

Figure 5:
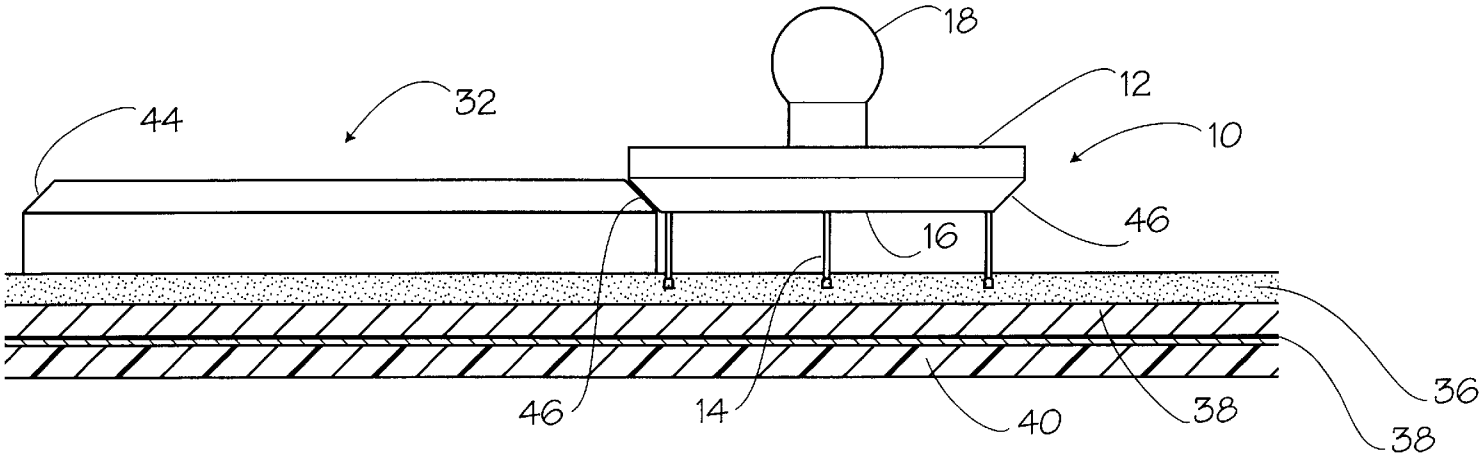
FIG. 5 is an end view showing the manner in which one beveled side edge region of the tile set hand tool of the present invention mates with a beveled edge region of an installed floor tile.
Figure 4:
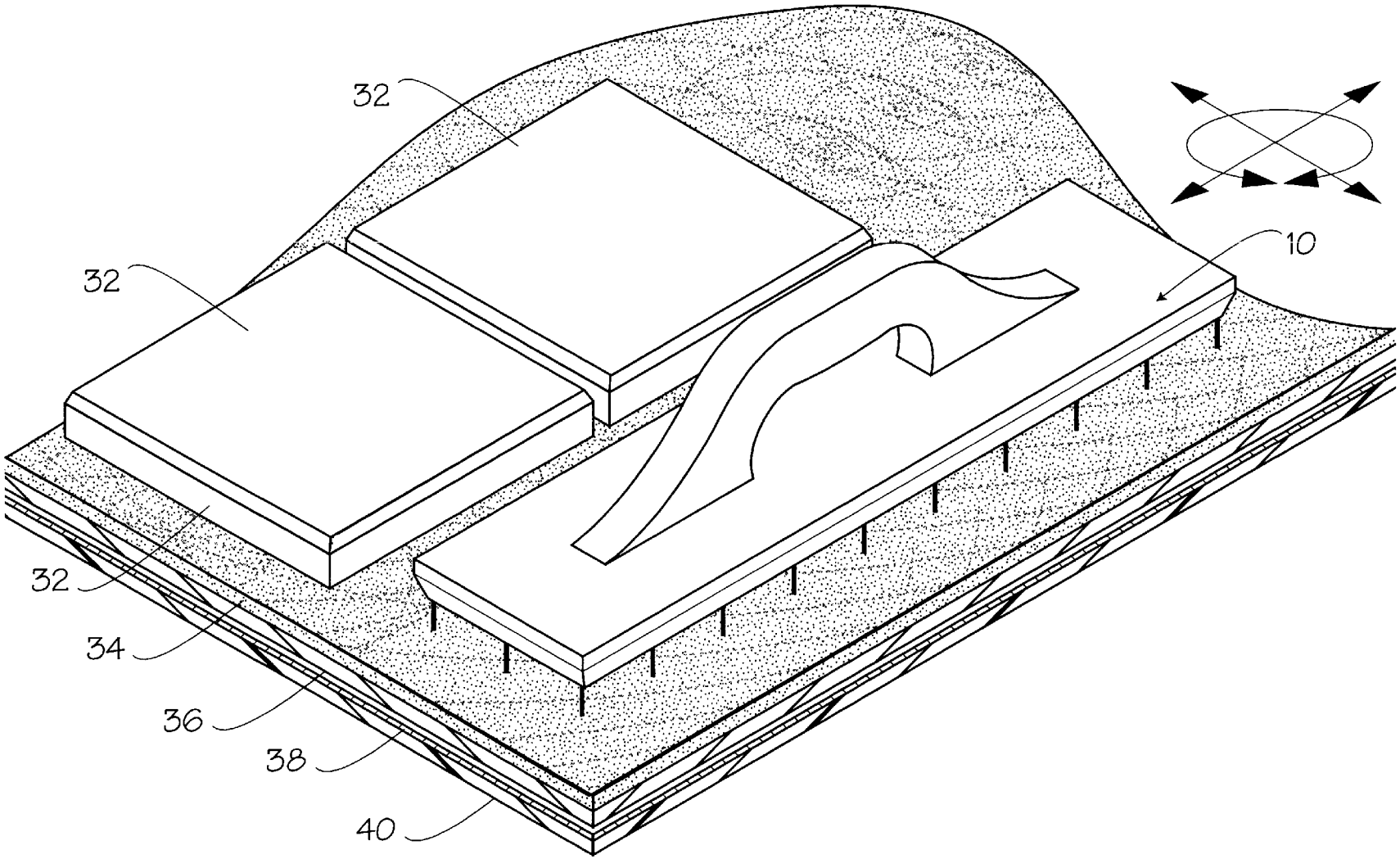
FIG. 4 is a perspective drawing showing four installed floor tiles and showing use of the tile set hand tool of the present invention.

Operation (i.e., the use) of tool 10 is depicted in FIGS. 4 and 5, wherein the tile setting tool or device 10 is shown being used in connection with floor tiles 32 (four being shown for illustrative purposes). As shown for a representative floor tile installation, tiles 32 are set in a relatively thick bed 34 of mortar or "mud," which is put down over a sheet of lath 36. In turn, lath sheet 36 is laid down over a paper sheet 38 which is installed over a wood substrate 40.

The layer of mortar 34 is typically applied and generally leveled by the use of a conventional hand-held trowel (not shown). As can be appreciated, when the layer of mortar 34 is leveled by use of a trowel, the mortar becomes relatively compacted so that when a floor tile 32 is placed on the surface of mortar bed 34, the tiles tend merely to rest on the mortar bed, their levelness thereby depending on the levelness of mortar bed 34. Moreover, as a result, tiles 32 are not well bonded to mortar bed 34.

However, when tile set tool or device 10 is used, nails or pins 14 thereof are pushed downwardly into mortar bed 34. As tool 10 is subsequently moved about, for example, in a random orbital manner, the nails effectively cut at least upper regions of mortar bed 34 into a great many small pieces so as to aerate and reduce the density of the mortar. Consequently, when floor tiles 32 are placed onto mortar bed 34, the tiles are enabled to sink into the mortar bed a sufficient distance to be well bonded in the mortar. In addition, tiles 32 can be tapped into the bed more than would otherwise be possible to thereby enable the easy leveling of the floor tiles relative to one another.

As shown in FIG. 5, tool 10 can be guided by beveled upper side edges 44 of floor tiles 32, against which beveled side edges 46 of plate 12 can bear. In addition, the mating of beveled side edges 44 and 46 enable the user of tool 10 to push a just-set floor tile 32 into place and to assist in leveling the tile.

Although there is described and illustrated herein an improved tile set hand tool for purposes of illustrating the manner in which the present invention may be used to advantage, it is to be understood that the invention is not limited thereto. Consequently, any and all variations and equivalent arrangements which may occur to those skilled in the applicable art are to be considered to be within the scope and spirit of the invention as set forth in the claims which are appended hereto as part of this application.

What is claimed is:

1. A tile setting hand tool for setting floor tile in a bed of mortar, the tool comprising:

a. a base plate having an under surface and an upper surface, and having a length, L, a width, W, and a thickness, t;

b. a number, N, of pins or nails attached to said plate, each of said pins or nails being spaced apart from one another and each depending a distance, d, from said plate under surface; and c. handle means projecting upwardly from said plate upper surface.

2. The tile setting hand tool as claimed in claim 1, wherein said plate is constructed from wood and wherein said thickness, t, is equal to about one-half inch.

3. The tile setting hand tool as claimed in claim 1, wherein said plate length, L, is about twelve inches.

4. The tile setting hand tool as claimed in claim 1, wherein said plate width, W, is about three inches.

5. The tile setting hand tool as claimed in claim 1, wherein said pins or nails are arranged in a plurality of columns and rows.

6. The tile setting hand tool as claimed in claim 1, wherein said pins or nails are arranged in three columns.

7. The tile setting hand tool as claimed in claim 1, wherein said pins or nails are arranged in three parallel, side-by-side columns along said length, L, of said plate, and wherein each of said columns contains nine equally spaced apart pins or nails.

8. The tile setting hand tool as claimed in claim 1, wherein said distance, d, of pin or nail projection equals about three-quarters of an inch.

9. The tile setting hand tool as claimed in claim 1, wherein lower regions of at least side edges of said plate are beveled inwardly at an angle, $\alpha$, which is about 45 degrees.

10. The tile setting hand tool as claimed in claim 1, wherein said pins or nails comprise finishing nails.

11. A tile setting hand tool for setting floor tile in a bed of mortar, the tool comprising:

a. a wooden base plate having an under surface and an upper surface, and having a thickness, t;

b. a number, N, of nails attached to said plate, each of said nails being spaced apart from one another and each projecting about three-quarters of an inch from said plate under surface; and c. handle means projecting upwardly from said plate upper surface.

12. The tile setting hand tool as claimed in claim 11, wherein said plate thickness, t, is equal to about one-half inch.

13. The tile setting hand tool as claimed in claim 1, wherein said plate has a length, L, that is about twelve inches and a width, W, that is about three inches.

14. The tile setting hand tool as claimed in claim 11, wherein the nails are arranged in three parallel, side-by-side columns along said length, L, of said plate, and wherein each of said columns contains nine equally spaced apart nails, the number, N, of nails being twenty-seven.

15. The tile setting hand tool as claimed in claim 11, wherein lower regions of at least side edges of said plate are beveled inwardly at an angle, $\alpha$, which is about 45 degrees.

16. The tile setting hand tool as claimed in claim 11, wherein said nails comprise finishing nails.

17. A tile setting hand tool for setting floor tile in a bed of mortar, the tool comprising:

a. a wooden base plate having an under surface, and having a length, L, a width, W, and a thickness, t;

b. N nails attached to said plate, each of the nails being spaced apart from one another and each projecting about three-quarters of an inch from said plate under surface, said nails being arranged in three parallel and side-by-side columns each having the same number of nails; and c. handle means projecting upwardly from said plate upper surface.

18. The tile setting hand tool as claimed in claim 17, wherein said plate length, L, is about twelve inches, the plate width, W, is about three inches and the plate thickness, t, is equal to about one-half inch.

19. The tile setting hand tool as claimed in claim 17, wherein lower regions of at least side edges of said plate are beveled inwardly at an angle, $\alpha$, which is about 45 degrees.

20. The tile setting hand tool as claimed in claim 17, wherein the number, N of nails is about twenty-seven and wherein the nails are finishing nails.

* * * * *